United States Patent [19]

Thoenen

[11] Patent Number: 4,817,924

[45] Date of Patent: Apr. 4, 1989

[54] SPRING CORE FOR A MATTRESS

[76] Inventor: Alan Thoenen, Reherstr. 12a, St. Gallen, Sweden, CH-9016

[21] Appl. No.: 188,109

[22] Filed: Apr. 28, 1988

Related U.S. Application Data

[63] Continuation of Ser. No. 908,903, Sep. 18, 1986, abandoned, which is a continuation of Ser. No. 650,780, Sep. 14, 1984, abandoned.

[30] Foreign Application Priority Data

Sep. 20, 1983 [DE] Fed. Rep. of Germany ..... 3333846

[51] Int. Cl.[4] ..... A47C 23/043

[52] U.S. Cl. ..... 267/91; 5/256; 5/257

[58] Field of Search ..... 267/91, 61 R, 95, 97; 5/256, 257, 260, 269

[56] References Cited

U.S. PATENT DOCUMENTS

| | | | |
|---|---|---|---|
| 1,744,389 | 1/1930 | Karr | 5/256 |
| 1,887,058 | 11/1932 | Karr | 5/269 |
| 1,895,429 | 1/1933 | Foster | 5/269 |
| 1,897,309 | 2/1933 | Karr | 5/256 |
| 1,963,055 | 6/1934 | Powers | 5/256 |
| 1,982,426 | 11/1934 | Goethel | 5/256 |
| 2,374,850 | 5/1945 | Wunderlich | 5/256 |
| 2,567,520 | 9/1951 | McInerney et al. | 5/256 |
| 2,581,686 | 1/1952 | McRoskey | 5/269 |
| 2,631,840 | 3/1953 | Bagenhagen | 5/256 |
| 4,095,297 | 6/1978 | Thomas | 5/256 |

FOREIGN PATENT DOCUMENTS 3321991 12/1983 Fed. Rep. of Germany .

*Primary Examiner*—John W. Caldwell, Sr.
*Assistant Examiner*—Alvin Oberley
*Attorney, Agent, or Firm*—Lilling & Greenspan

[57] ABSTRACT

The spring core for a mattress consists of several, identically formed spring coils arranged in side by side rows with each row forming a wire piece having an upper and a lower mutually aligned end spiral in a U-shape, and having opposite legs joined together by a base webb. Adjacent coil springs are joined together at their end spirals along abutting legs by helical connecting springs. To arrange the springs at tight angles in rows and columns, a length of one leg is greater than the length of another leg and all the coil springs are oriented in the same direction, except along a edge region of the spring core.

2 Claims, 4 Drawing Sheets

SPRING CORE FOR A MATTRESS

This is a continuation of co-pending application Ser. No. 908,903, filed on Sept. 18, 1986, which was a continuation of application Ser. No. 650,780, filed Sept. 14, 1984, both of which are abandoned.

FIELD OF THE INVENTION

The invention relates to a spring core for a mattress with several identically formed coil springs arranged in rows side by side, each of which is formed of a wire piece and has an upper and a lower end spiral in alignment with one another. Each end spiral is approximately U-shaped and its opposite legs are connected by a base web. Adjacent coil springs are joined together at their end spirals by helical connecting springs along the contiguous legs.

BACKGROUND OF THE INVENTION

A spring core as described above is described in DE-OS No. 3,321,991 of the same applicant. There, however, the opposite legs of the U-shaped end spirals are made of equal length. During automatic assembly of the spring core, adjacent coil springs are joined together at their end spirals along contiguous legs by helical connecting springs. In the assembly of coil springs, according to the subject of DE-OS No. 3,321,991, it was found that an offset of the coil springs will result, that is, without corrective measures in the automatic assembling machine the spring core, whose outer contours are rectangular or square, would be distorted to a rhombus. The coil springs, arranged in rows and columns, thus do not form an angle of 90°, but an angle differing therefrom, which on the whole would lead to rhombic external dimensions of the spring core unless appropriate corrective measures are taken in the automatic assembling machine. This, however, involves increased expense.

SUMMARY OF THE INVENTION

It is the object of the invention, therefore, to develop a spring core according to the subject of DE-OS No. 3,321,991 in such a way that automatic assembly of such a spring core is possible without any special corrective measures. The previously described offset of the coil springs is to be avoided.

For the solution of the problem posed, the invention is characterized in that the length of one leg is greater than the length of the other leg, and that with the exception of an edge region of the spring core all coil springs are oriented alike.

It has, in fact, been found that by the selection of different lengths of the opposite U-legs of the U-shaped end spirals the offset of the coil springs, which would otherwise occur, is prevented.

It is essential that in the area of connection of adjacent, contiguous end turns of adjacent coil springs the helical connecting spring always embraces one long leg of one coil spring and one short leg of the other coil spring.

In this connection it is preferred to make the number of spirals of the helical connecting spring, embracing a long leg, greater by one spirals than the number of spiral embracing a short leg.

In the area of connection of adjacent, contiguous end spirals, therefore, the short leg of one end spiral of a specific coil spring is embraced by four spirals of the helical connecting spring, while the longer leg of the adjacent end spiral of the adjacent coil spring is embraced by five spirals of the helical connecting spring.

A simple assembly of the coil springs, arranged in rows and columns, by the connecting springs is thereby achieved. An offset no longer occurs because by comparson an automatic correction of the otherwise existing offset occurs. This makes expensive corrective measures on the assembling machine unnecessary, and the assembly is simplified and more cost-effective.

The solution of the problem posed is provided by orienting alike by all coil springs with the exception of the coil springs on the narrow end faces being and yet there results a homogeneous spring core with excellent support.

On the narrow sides, the coil springs are inserted turned around, to avoid having the outwardly open end spirals pointing to the outside of the mattress. Otherwise there would be danger that the outwardly directed open end spirals would fray the upholstery. Due to the end spirals pointing inwardly in the marginal region it is possible to place a circling spanning wire all around the spring core in the upper and lower planes, with the spanning wire connected with the edge-side legs of the end spirals of the coil springs by an associated connecting spring circling along the edge.

The slightly arcuate curvature of the two opposite legs of the U-shaped end spirals facilitates the gripping of these end spirals by the pliers of the assembling machine.

A preferred feature of the invention is that a slightly arcuate wire piece, bent slightly inward toward the spring axis, starts at the free end of the longer leg. At the free front end of this wire piece is a flex end which is bent out of the plane of the end spirals obliquely inward in the direction of the spring axis. This arrangement ensures that the end of the end spirals does not rub open the upholstery and does not come in contact with the coil springs (even if the latter are under extreme load). Contact noises are thereby avoided.

In a preferred embodiment of the present invention, each end spiral is provided with five bends. The first bend constitutes the transition from the spiral of the coil spring to the shorter leg. The second bend constitutes the transition from the shorter leg to the base web, and the third bend constitutes the transition from the base web to the longer leg of the U-shaped end spiral. The fourth bend forms the transition from the longer leg to the wire piece, and the fifth bend forms the transition from the wire piece to the obliquely bent flex end. By the proposed arrangement of the bends an excellent fixation of the legs in the helical connecting spring embracing them is obtained. Only minimal displacements of the coil springs in the connecting spring are caused; and, noxious squeaking and scratching noises no longer occur.

The subject of the present invention derives not only from the subject of the individual claims, but also from the combination of the individual claims.

All data and features disclosed in the documents, in particular the spatial design illustrated in the drawings, are essential to the invention insofar as they individually or in combination are novel relative to the prior art.

BRIEF DESCRIPTION OF THE DRAWINGS

In the following, the invention will be explained more specifically with reference to drawings representing merely a mode of realization. Additional features essential to the invention and advantages of the invention are evident from the drawings and their description.

DETAILED DESCRIPTION OF THE INVENTION

Figure 1:
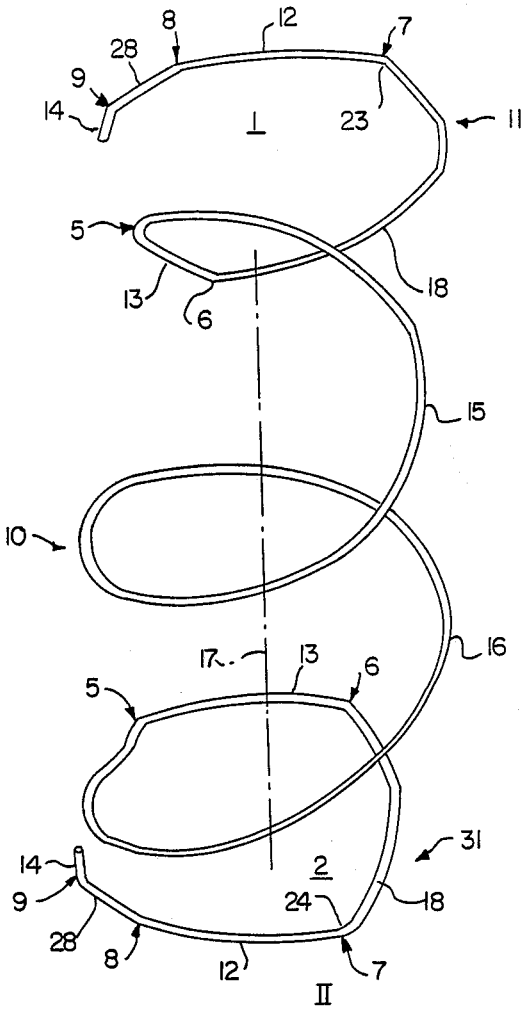
FIG. 1 is perspective view of a coil spring.

The coil spring 10 shown in FIG. 1 preferably comprises two successive spirals 15, 16, the upper spiral 15 terminates in the upper plane of the spring core in a U-shaped end spiral 11, while the lower spiral 16 terminates in the lower plane 2 of the spring core in a lower end spiral 31. The two end spirals 11, 31 are alike, so that the description of one end turn is sufficient. The end spirals 11, 31 are aligned relative to the spring axis 17 one on top of the other. The active length of wire which determines the spring property of the coil spring 10 extends from position 23 of the upper end spiral 11 down to position 24 of the lower end spiral 31. As a result, parts of the end spirals 11, 31 also participate in the spring work, in particular, the base web 18 and the shorter leg 13, contiguous thereto, of the respective U-shaped end spiral 11, 31. This arrangement explains the very favorable wire utilization achieved with relatively little wire obtaining superior spring support properties.

Figure 2:
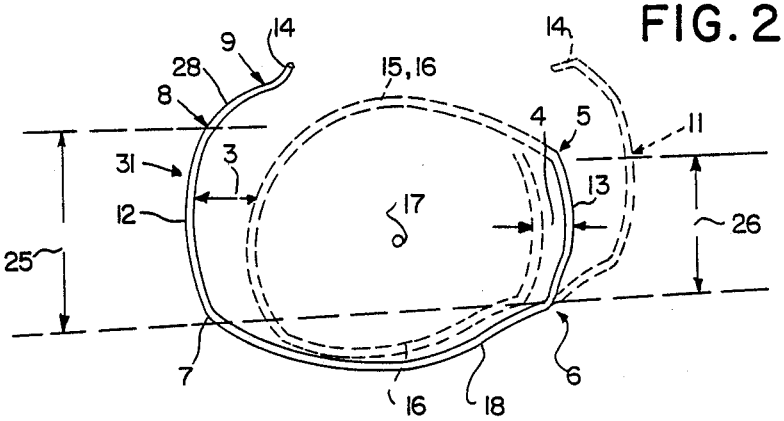
FIG. 2 is a top plan view of an end face of the coil spring.

For the explanation of the configuration of the U-shaped end spirals 11, 31 reference is made to FIGS. 1 and 2. In FIG. 2, the bottom view of the lower end spiral 31 is shown in solid lines, while the parts thereabove, in particular the upper end spiral 11, are indicated in broken lines. For greater clarity the shorter leg 13 of the upper end spiral 11 is not shown in FIG. 2.

The U-shaped end spiral should be laterally spaced from the spirals 15, 16 by the spacing 3 of the longer leg 12 of the end spiral from the associated spiral 16, while on the opposite side the shorter leg 13 has a smaller distance 4 from spiral 16 of coil spring 10. These distances 3, 4 ensure that, even under extreme load on coil spring 10, the end spirals do not come in contact with the spirals 15, 16.

As has been described above, the respective end spiral 11, 31 is bent in U-shaped form. The end spiral 31, shown in solid lines in FIG. 2, is formed by a shorter leg 13, by the base web 18 forming the base of the U, and by the longer leg 12.

The shorter leg 13 of the U-shaped end spiral 31 abuts by a first bend 5 on the descending spiral 16 of coil spring 10. The shorter leg 13 has a length 26. Via a second bend 6, the shorter leg 13 converges in the base web 18, which in turn is slightly curved. At the opposite end of base web 18 there is a third bend 7, with which one end of the longer leg 12 connects. The latter, too, is slightly curved, has a length 25, and extends to the fourth bend 8. At this point begins a wire piece 28, again slightly curved and bent out of the plane 1, 2 of the mattress, and at the free front end of the wire piece the flex end 14 begins by way of a fifth bend 9.

Figure 5:
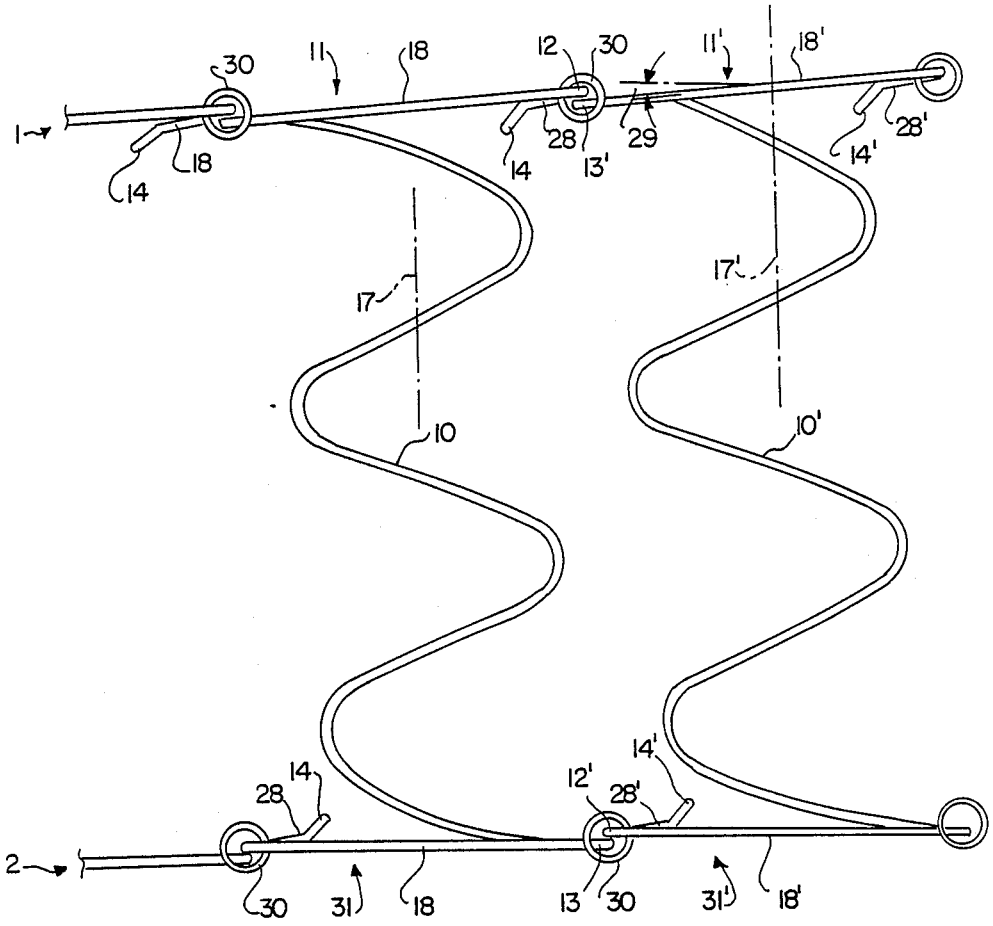
FIG. 5 is a side view of the spring core along the direction of arrow V in FIGS. 3 and 4.

The significance of the bent wire piece 28 with the adjoining flex end 14 is evident from FIG. 5. It can be seen that in the spring core the wire pieces 28 with the flex ends 14 starting there are bent obliquely inward in the direction of the spring axis 17, so that neither contact with the spirals 15, 16 of the coil springs 10, 10' nor a fraying of the upholstery is to be feared. The respective wire end of the open end spirals 11, 31 is thereby optimally protected.

The upper end spiral 11 is formed in analogy to the lower end spiral 31, as is evident from the representation in broken lines in FIG. 2. What is essential here is that the two longer legs 12 and the two shorters legs 13 of the two opposite and aligned end spirals 11, 13 are opposite each other in exact mirror symmetry relative to a line passing lengthwise through the spring axis 17. A symmetrical load on coil spring 10 is thereby achieved.

Figure 3:
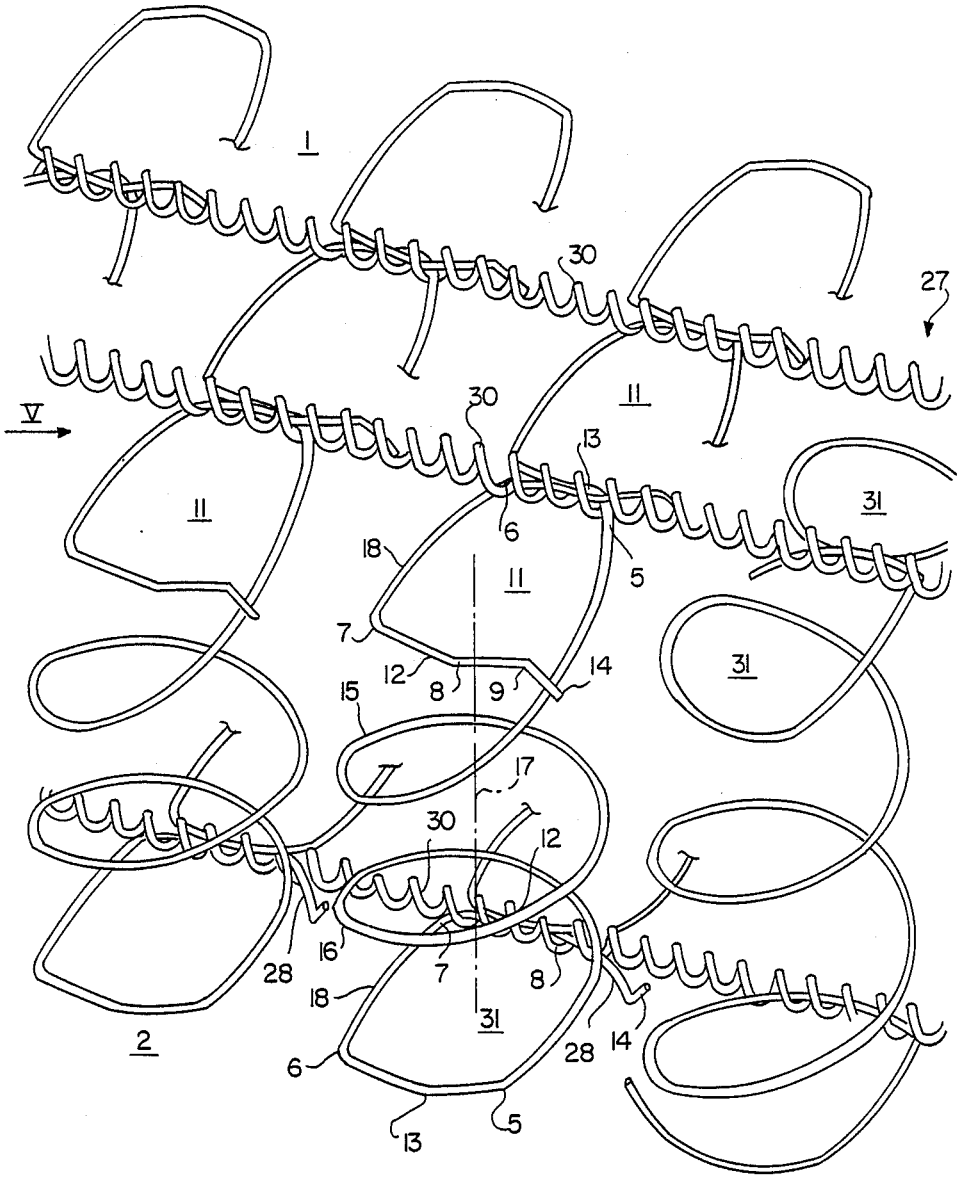
FIG. 3 is a perspective view of a section of a spring core.
Figure 4:
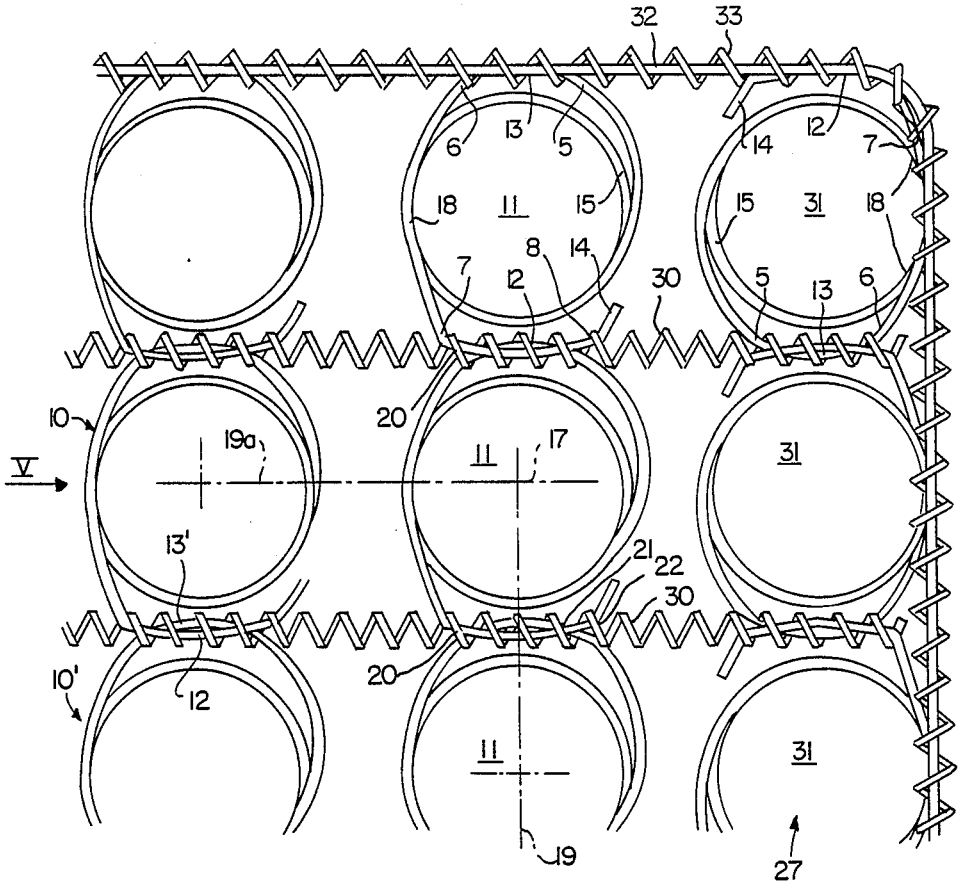
FIG. 4 is a top plan view of a corner portion of the spring core.

FIGS. 3 to 5 show a partially assembled spring core. In FIGS. 3 and 4 the edge region 27 of the spring core is also shown, where it can be seen that only in this edge region 27 the otherwise co-directional coil springs 10 are turned around, so that the normally lower end spiral 31 is at the top. It is achieved thereby that the base web 18 always forms the outer edge of the spring core, and it thus becomes possible to connect a circling spanning wire 32 in the upper and lower planes 1, 2 of the spring core to the end spirals of the associated coil springs along the edge and to fasten it to these coil springs by the connecting spring 33 circling around the edge side.

FIGS. 3 and 4 show the arrangement in rows and columns of the coil springs 10. The connecting lines 19 through the spring axes 17 form vertical lines in the drawing plane of FIG. 4, while in analogous manner horizontal lines are defined by the connecting lines **19*a*. The connecting lines 19, 19*a*** intersect at right angles, so that the edge sides of the spring core form right angles also. Due to the formation of said right angles, the offset described above in connection with DE-OS No. 33 21 991, which could be eliminated only by appropriate corrections on the assembling machine, does not occur.

The right angles are obtained as illustrated in FIG. 4 by the fact that at the helical connecting spring both the longer leg 12 of one coil spring and the shorter leg 13 of the adjacent coil spring come out at spiral 20, while on the opposite side, after passing through four spirals, the shorter leg 13 of one coil spring comes out at spiral 21, while the longer leg 12 of the adjacent coil spring comes out one spiral later, namely at spiral 22.

Further it is evident from FIGS. 3 and 4 that because of the flexures 5, 6 in the region of the shorter legs 13 an excellent fixation of leg 13 in the region of the connecting spring 30 is obtained. Similarly also the longer leg 12 is fixed in the region of the flexures 7, 8 in the connecting spring 30.

In the edge region 27 the coil springs are turned around, so that the end spiral 31 normally at the bottom is now at the top.

In FIG. 5, two adjacent coil springs lying side by side are illustrated. To indicate which part belongs to which coil spring, all reference symbols of the coil spring shown at the right in FIG. 5 are indicated with a prime sign. The same designations are contained also in FIG. 4 at the lower left, to indicate where the two coil springs 10, 10' shown in FIG. 5 are arranged in the spring core.

From the illustration in FIG. 5 it becomes evident that in the region of the connecting springs 30, each of which receives a longer leg 12 of one coil spring 10 and a shorted leg 13' of the adjacent coil spring 10', these two legs 12, 13' are arranged one on top of the other in the clear cross-section of the connecting spring 30. Thereby these legs 12, 13' are optimally secured against displacement, thereby ensuring that no undesired scratching or squeaking noises can occur.

It is further evident from FIG. 5 that the base webs 18, 18' of adjacent coil springs 10, 10' overlap in the manner of shingles, as it were, which leads to said firm seating of the legs 12, 13' and 12', 13, respectively, in the connecting springs 30. To obtain said overlap, the longitudinal axes of the base webs 18, 18' must be inclined on the horizontal at an angle 29, as can be seen from FIG. 5.

By the described co-directional arrangement of all coil springs with the exception of those which are turned around in the edge region 27, and by the unequal length of adjacent legs 12, 13, the advantage of a surprisingly fast and simple assembly is achieved without having to take any special measures to avoid the offset described.

I claim:

1. A spring core for a mattress, comprising a plurality of identically configured helical circular springs each made of a single piece of wire having a central spiral position (15,16) defining a spring axis (17) and terminating at opposing ends with upper and lower end spirals (11,31) disposed in planes substantially perpendicular to said spring axis, said springs being arranged in side by side rows and connected with each other at said upper and lower end spirals (11,31) by connecting elements (30) arranged in said planes, said upper and lower end spirals (11,31) each being substantially U-shaped and having a longer leg (12) and a shorter leg (13) connected to each other by a base web (18), said legs (12,13) of each end spiral being laterally outwardly spaced from said central spiral portion in relation to said spring axis, the radial spacing between said longer leg (12) and said central spiral portion (15,16) being greater than the corresponding spacing between said central spiral position and said associated shorter leg (13) of the same end spiral (11,31), the opposing end spirals of each spring being rotated approximately 180 degrees in relation to each other to dispose the longer and shorter legs of the upper end spiral of each spring in mirror symmetry to the longer and shorter legs, respectively, of the associated lower end spiral.

2. A spring core as defined in claim 1, wherein said central spiral portion comprises two successive generally circular spirals.

* * * * *